US006523191B2

(12) United States Patent
Lahay et al.

(10) Patent No.: US 6,523,191 B2
(45) Date of Patent: Feb. 25, 2003

(54) ACOUSTICALLY ACTIVE HOT TUB

(75) Inventors: Glenn Lahay, White Rock (CA); Garth Jackson, Vancouver (CA)

(73) Assignee: Beachcomber Hot Tubs Inc., Surrey (CA)

( * ) Notice: Subject to any disclaimer, the term of this patent is extended or adjusted under 35 U.S.C. 154(b) by 0 days.

(21) Appl. No.: 09/847,917

(22) Filed: May 2, 2001

(65) Prior Publication Data

US 2002/0162168 A1 Nov. 7, 2002

(51) Int. Cl.[7] ..... A47K 3/00; A47K 3/10
(52) U.S. Cl. ..... 4/541.1; 4/584; 601/2
(58) Field of Search ..... 4/541.1, 541.2, 4/584; 601/2, 47, 157, 160; 607/85

(56) References Cited

U.S. PATENT DOCUMENTS 3,585,991 A * 6/1971 Balamuth ..... 4/541.1
4,575,882 A 3/1986 Diamond ..... 4/541.1
5,339,804 A * 8/1994 Kemp ..... 601/2
5,702,353 A * 12/1997 Guzzini et al. ..... 601/2
5,735,226 A * 4/1998 McNeal ..... 114/222
6,209,472 B1 * 4/2001 Staerzl ..... 114/222

FOREIGN PATENT DOCUMENTS

DE 199 02 875 7/2000

* cited by examiner

*Primary Examiner*—Gregory Huson
*Assistant Examiner*—Tuan Nguyen

(57) ABSTRACT

An acoustically active hot tub has audio transducers affixed to the underside of the shell forming the hot tub. The hot tub reproduces sound from a sound source such as a radio or compact disc player. Effective transducers will generally have a frequency response somewhere in the range of 20 Hz–20,000 Hz. The transducers are affixed to the underside of the shell of the hot tub by means of blocks of marine grade plywood embedded into the material forming the underside of the shell, with the transducers mounted onto the blocks. Also provided is a new method for manufacturing the hot tub of the invention.

14 Claims, 3 Drawing Sheets

ACOUSTICALLY ACTIVE HOT TUB

TECHNICAL FIELD

The present invention relates to hot tubs, and more particularly to sound systems for use with hot tubs.

BACKGROUND

Over the years, many improvements have been made to hot tubs and spas, and to methods for manufacturing them. Typically, a hot tub is made today by first forming an acrylic top sheet into a particular configuration in a mold. Fiberglass and similar material is then sprayed and/or rolled onto the underside of the acrylic sheet to strengthen it, forming a rigid shell. Holes are then drilled through the shell for the necessary plumbing. Plumbing and a suitable pump are then added. A skirt, typically made of wood, is then added to the shell, and often a foam is sprayed or otherwise injected into the remaining cavities in the underside of the hot tub to provide insulation and further rigidity.

It is becoming popular nowadays for hot tub manufacturers to add sound systems to hot tubs. Such systems are intended to allow hot tub users to enjoy listening to their favorite music while soaking in their hot tubs. Such sound systems typically comprise a sound source such as a radio or compact disc player, and associated speakers.

Some hot tub manufacturers are known to provide hot tubs having integrated speakers. Generally, as shown in U.S. Pat. No. 4,575,882, which issued on Mar. 18, 1986 to H. E. Diamond, such hot tubs are provided with upwardly extending wall portions which are an integral part of the hot tub shell. Speaker apertures are cut out of the shell, and speakers mounted therein.

Such current hot tub sound systems have many disadvantages which are sought to be ameliorated by the inventors of the present invention. Most importantly, prior art systems, as shown in further detail in FIG. 1, require speakers to be placed above the high-water line of the hot tub to keep them dry. Further, unless the speaker material is waterproof, the speakers themselves must be shielded from water splashed up from the hot tub, and generally from the humid environment.

Further, prior art systems typically have the speakers installed in humps molded at the corners of the hot tub, as shown in FIG. 1. This causes a problem for the users of the hot tub, since most hot tubs are arranged to allow users to sit in the corners. The quality of the sound provided by this arrangement is not optimal for the user sitting in a corner since that user will generally receive sound mostly from the speaker immediately behind his or her head. Any stereo effect which might otherwise be achieved is therefore lost. Furthermore, the person seated directly in front of a speaker will hear the speaker's output much more loudly than someone sitting in the corner opposite the speaker.

A further problem with such prior art systems is that custom hot tub covers are required to accommodate the humps formed in these types of hot tubs. Such custom covers are expensive.

The present invention addresses these shortcomings of the prior art.

SUMMARY OF INVENTION

The present invention provides, in its broadest form, an acoustically active hot tub which has a shell formed of an acrylic top sheet having fiberglass material applied to its underside, and a plurality of audio transducers affixed to the underside of the shell. The audio transducers accept electrical signals from a sound source and transform them into vibrations which are transmitted to the shell of the hot tub, causing the shell to vibrate, producing sound.

In a preferred embodiment, the audio transducers are affixed to blocks embedded into the fiberglass material applied to the underside of the shell. They are preferably screwed into the blocks, which are preferably made from marine grade plywood.

A sound source maybe provided integrally with the hot tub for convenience, with speaker wires running from the sound source to the audio transducers. A vehicular radio and compact disc player may be a suitable sound source. A remote control may be provided for operating the sound source from within the hot tub.

In a further embodiment, a cover encloses each one of the audio transducers, shielding them from foam which may be sprayed into the hot tub for rigidity and insulation.

The invention also provides a new method for making an acoustically active hot tub, wherein a sheet of acrylic is molded into a predetermined form, and a fiberglass material thereafter applied to the underside of the sheet of acrylic, thereby forming a hot tub shell. The new step in the process is the affixing of a plurality of audio transducers to the underside of the shell. This affixing step may be achieved by embedding, for each transducer, a block of marine grade plywood into the fiberglass material before the material dries completely, and affixing each one of the transducers to one of said blocks, either by screwing them thereto, or by epoxying them thereto.

BRIEF DESCRIPTION OF DRAWINGS

In drawings which illustrate specific embodiments of the present invention, but which should not be construed as restricting the spirit or scope of the invention in any way.

DESCRIPTION

Throughout the following description specific details are set forth in order to provide a more thorough understanding of the invention. However, the invention may be practiced without these particulars. In other instances, well known elements have not been shown or described in detail to avoid unnecessarily obscuring the present invention. Accordingly, the specification and drawings are to be regarded in an illustrative, rather than a restrictive, sense.

Figure 1:
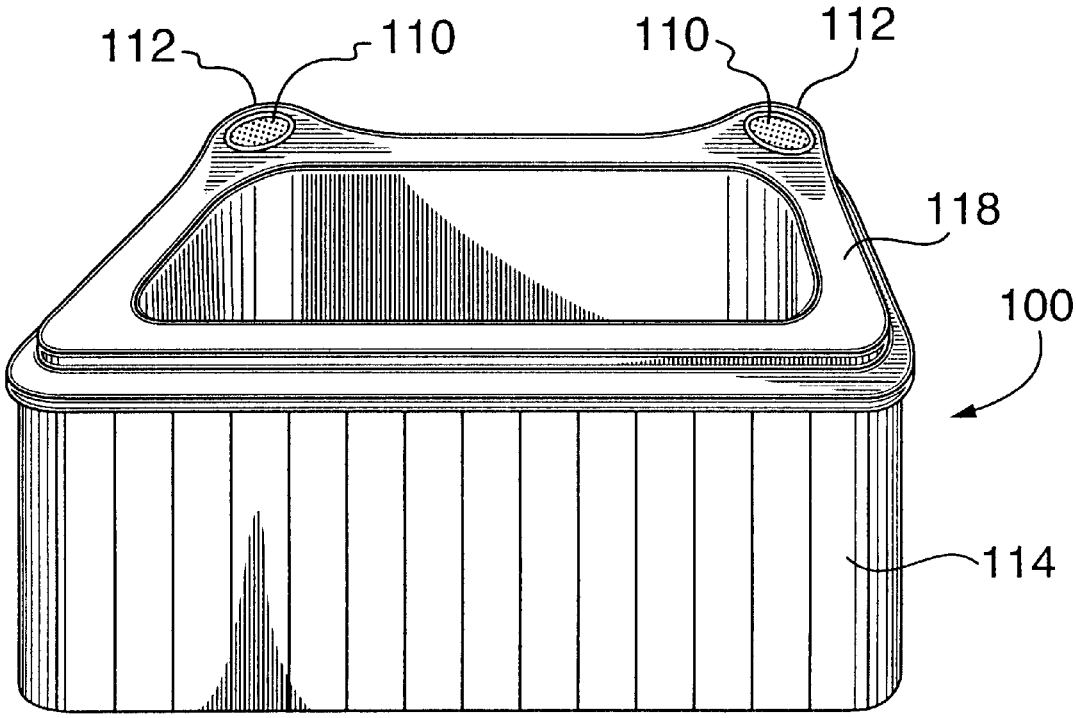
FIG. 1 PRIOR ART
FIG. 1 is a perspective view of a hot tub employing a prior art sound system.

Referring first to FIG. 1, a modern prior art hot tub 100 is typically constructed of a sheet of acrylic material 118 which is molded in a mold into a form having a certain predetermined size and shape. There are a wide variety of sizes and shapes of such forms. Fiberglass is added to the underside of the acrylic sheet 118 to form a hot tub shell. A side skirt 114 is typically added to this shell to form a generally square or rectangular tub having vertical side walls; circular hot tubs are also known.

In some prior art hot tubs, humps 112 are formed as part of the hot tub shell, and speakers are mounted within speaker apertures 110 cut out from humps 112. Again, such an arrangement is undesirable for the reasons described above.

Figure 2:
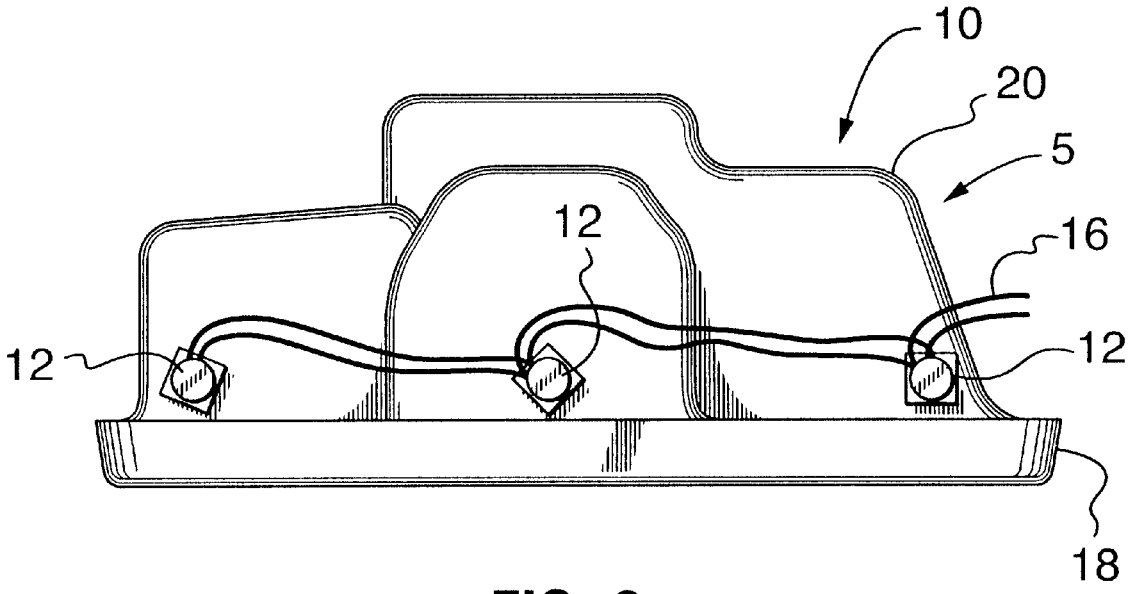
FIG. 2 is a side view of the underside of the shell of a hot tub made in accordance with one embodiment of the present invention.

The present invention, which is denoted herein generally by the numeral "10", also incorporates an acrylic/fiberglass shell, as shown in FIG. 2. Hereafter, this shell of the present invention is denoted "5".

FIG. 2 shows the underside of the shell 5 of the present invention. As noted earlier, shell 5 is formed by molding an acrylic sheet 18 into a predetermined form and applying fiberglass or a fiberglass-containing material 20 or another similar resinous material to the underside of acrylic sheet 18. Generally, the terms "fiberglass" and "fiberglass material", as referred to herein, refer to any resinous compound which might be applied to the underside of hot tub shells during the course of manufacturing hot tubs, whether or not they contain fiberglass per se, as a major component.

The present invention provides a plurality of audio transducers 12, which are also known as acoustical transducers, fixed to the underside of shell 5, as shown in FIG. 2.

Although unknown in the hot tub art, it may be known to some experts familiar with the sound reproduction arts that acoustical transducers such as audio transducers 12 transform electronic sound signals provided by a sound source into vibratory motion. If this vibratory motion is transmitted correctly to a sounding surface, this surface can be caused to vibrate, creating sound waves.

Audio transducers 12 have frequency response and power handling parameters which depend primarily upon their size. Effective transducers for use in the present invention will generally have a frequency response somewhere in the range of 20 Hz–20,000 Hz. It has been surprisingly determined by the inventors that such transducers, if properly affixed to the underside of a shell of a hot tub, will cause that shell to vibrate with a range of frequencies suitable for transmitting sounds, and in particular, with a frequency range suited to transmitting voice and music sounds. By adding a plurality of such transducers to a hot tub, the hot tub shell can be made acoustically active, acting generally in the manner of an audio speaker.

Figure 3:
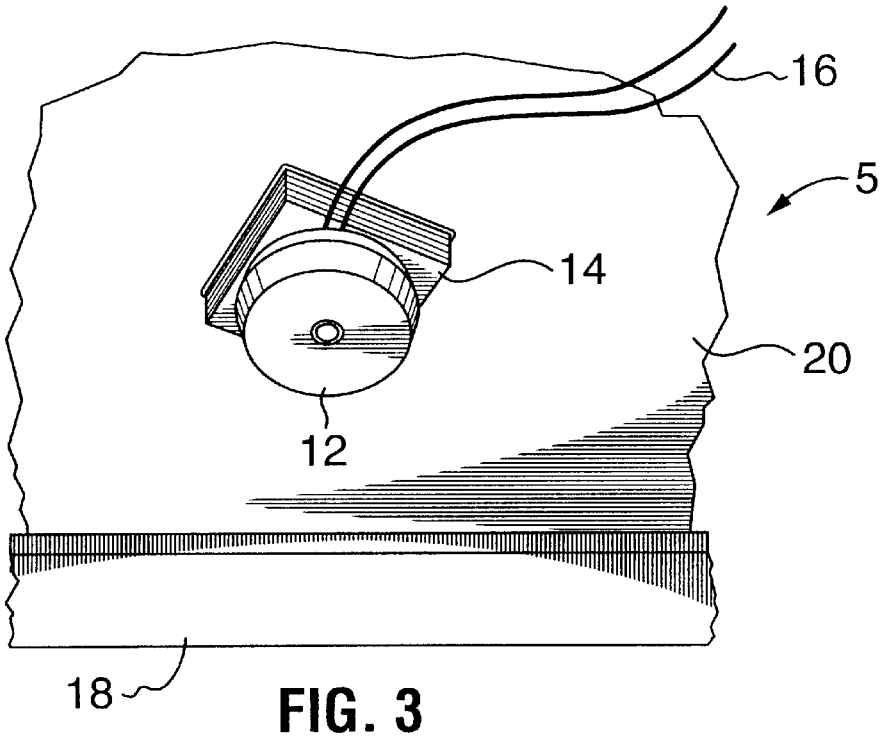
FIG. 3 is a close up perspective view of one of the audio transducers affixed to the shell shown in FIG. 2.

FIG. 3 shows a close up view of an audio transducer 12 of the present invention affixed to the underside of shell 5. There are a variety of ways of affixing audio transducer 12 to shell 5, but a preferred way is by means of a block 14, which may be made from any material suitable for transmitting vibrations, but is preferably made from wood, and most preferably from marine grade plywood.

The inventors have determined that the transducers 12 may be suitably affixed to shell 5 by embedding block 14 into the fiberglass material 20 which is applied to the underside of the acrylic sheet 18, before the fiberglass 20 has dried. This affixes block 14 firmly to shell 5 once the fiberglass 20 dries. Plywood is a preferred material for block 14 because fiberglass material 20 readily soaks into plywood. A block 14 made from plywood is therefore more strongly bondable to shell 5 than a block made from other materials might be.

Transducer 12 is then screwed into block 14. Preferably, block 14 has a pre-drilled hole (not shown) in its face to accept a screw (not shown) attached to the underside of transducer 12.

It has been determined by substantial experimentation that it is not essential to the practice of the invention that the transducers 12 be mounted in particulars locations about shell 5. However, the inventors have determined that better sound quality is achieved if the transducers 12 are affixed to the top third of the shell 5, as the hot tub is looked at in its normal, upright position. Transducers 12 do not necessarily have to be mounted above the high-water line of hot tub 10.

Speaker wires 16 connect each of transducers 12 to a sound source 30 (FIG. 5), either in series, or in parallel. Preferably, sets of audio transducers are provided, each set wired to accept a different sound channel (for example, the left and right channels of a stereo signal). Transducers 12 may be different sizes and may have different frequency responses.

Figure 4A:
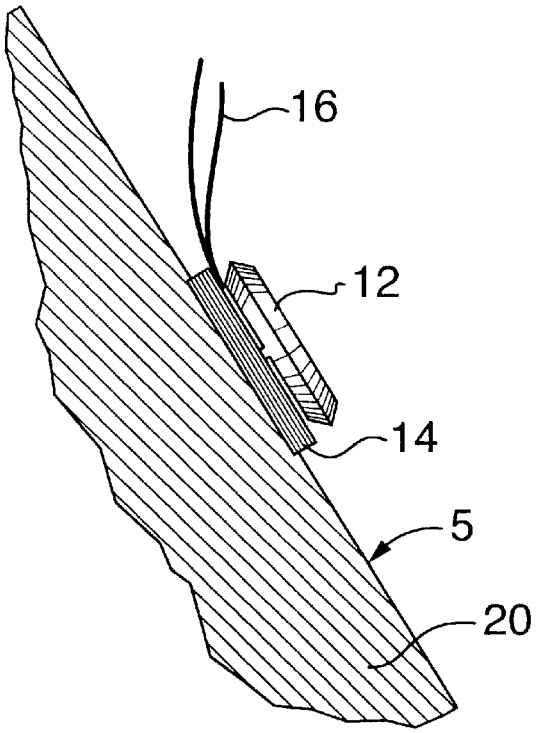
FIG. 4A is a side view of the audio transducer shown in FIG. 3.

FIG. 4A shows a side view of the block 14 embedded into shell 5, and transducer 12 screwed into block 14. In this view, block 14 is not entirely embedded within the fiberglass material 20 of shell 5, but it could be. In the preferred embodiment, however, since fiberglass material 20 typically has a thickness less than that of block 14, block 14 protrudes beyond the surface of shell 5, as shown.

It will be readily understood that to work efficiently, audio transducer 12 must be free to vibrate. As mentioned before, however, in the traditional manner of manufacturing hot tubs, an insulating foam is injected into the cavities between shell 5 and the hot tub skirt. Such foam would hamper the operation of transducer 12, and accordingly, the invention contemplates that a cover 22 (FIG. 4B) is placed over transducer 12, enclosing it and keeping the insulating foam away from it. Cover 22, of course, must be suitably sized to keep from interfering with the sides and top of transducer 12.

Figure 4B:
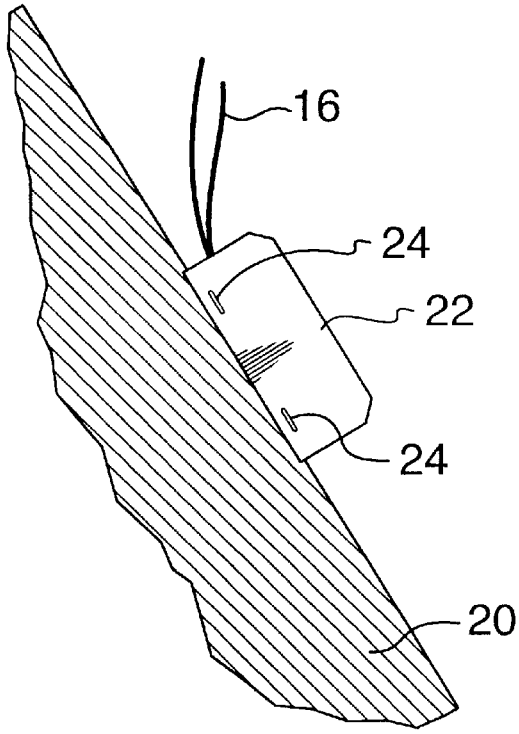
FIG. 4B is a view of the audio transducer shown in FIG. 4A, but covered by a cover.

If block 14 is properly sized, and if block 14 protrudes from the surface of shell 5, cover 22, which may be made of a light plastic material, can conveniently be stapled to the sides of block 14 with staples 24, as shown in FIG. 4B. Wires 16 may be permitted to emerge from the bottom of cover 22 or through holes formed in cover 22.

Figure 5:
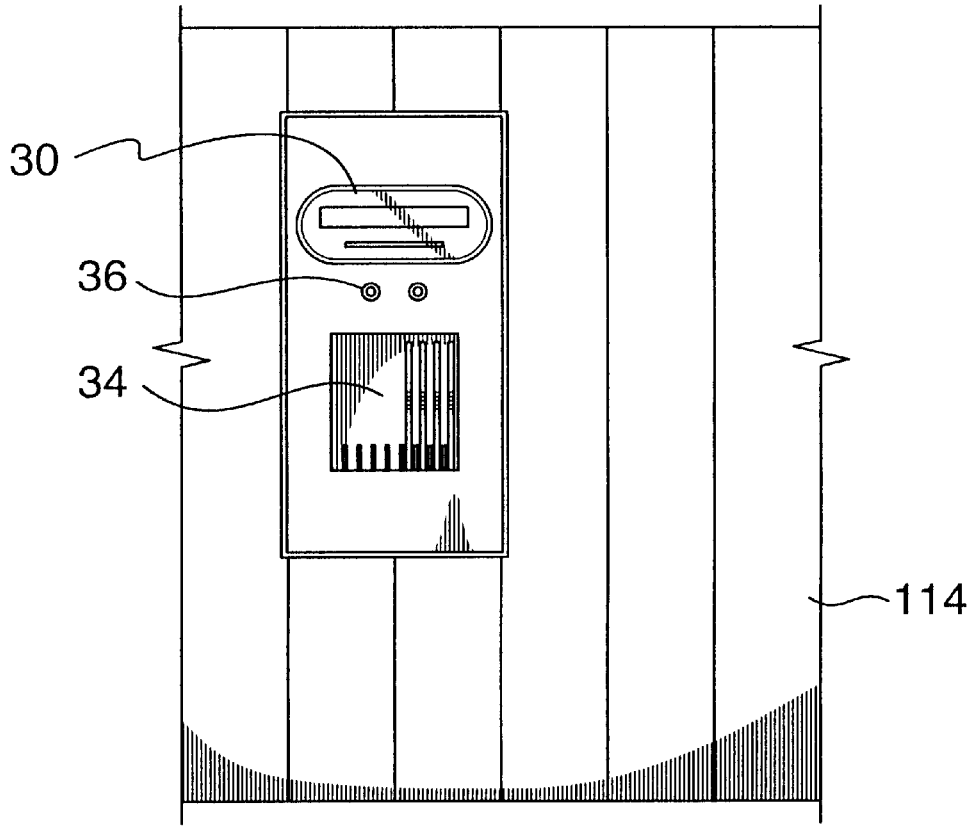
FIG. 5 is a view of a portion of the side of the hot tub of the present invention, showing an integrated sound producing system comprising a radio and compact disc player.

The sound source 30 providing sound signals to transducers 12 may be of any conventional type, and may be separate from the hot tub, but in a preferred embodiment of the present invention the sound source 30 is integrated into the hot tub, as shown in FIG. 5, and is accessible from the exterior of the hot tub. Of course, conventional precautions must be taken to isolate sound source 30 and all associated wiring from water and ambient moisture.

Sound source 30 may conveniently be a radio and compact disc player of the type made for use in vehicles such as automobiles and boats. In this case, a transformer (not shown) may be provided to transform household 120V AC current, which is typically used to power the spa pump, into 12V DC current, to power sound source 30. An AM/FM antenna may be incorporated within the shell, or attached to the interior of the skirt.

Figure 6:
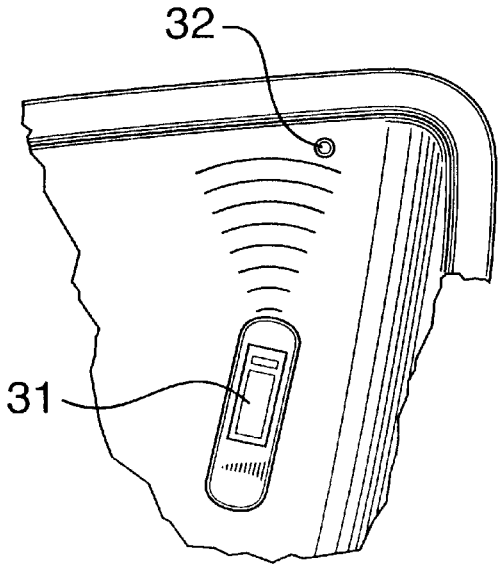
FIG. 6 is a perspective view of a portion of the interior of the hot tub of the present invention, showing the mounting location of an infrared receiver/repeater associated with the sound producing system shown in FIG. 5.

It is generally inconvenient for a hot tub user to control sound system 30 from within the hot tub if sound source 30 is accessible only from the exterior of hot tub 10. Accordingly, in a preferred embodiment of the invention, the sound source 30 is operable by an infrared remote control 31. In this embodiment, since the remote control 31 may not be able to be suitably pointed towards the sound source 30 from within hot tub 10, an infrared receiver/repeater 32 may be mounted in an upper portion of the wall of hot tub 10, as shown in FIG. 6. Infrared receiver/repeater accepts infrared signals from the remote control 31 and repeats them to an infrared receiver associated with sound source 30.

It is contemplated that many desired aspects of a typical sound system may be provided as part of the invention for a user's convenience. For example, external speaker jacks 36 may be provided to allow the use of remote, external speakers with the system. A storage space 34, as shown in FIG. 5, may also be provided for CD's and for the remote control which operates the system.

As will be apparent to those skilled in the art in the light of the foregoing disclosure, many alterations and modifications are possible in the practice of this invention without departing from the spirit or scope thereof. For example, as noted earlier, although the preferred embodiment of the invention relies on the affixing of transducers 12 onto the underside of shell 5 by means of embedding a block 14 into the fiberglass material of the shell, this is not essential to the invention. What is important is that they be affixed somehow. Transducers 12 may themselves be epoxied directly to shell 5 or may be epoxied to block 14, rather than screwed to block 14. Further, although speaker wires 16 are described, they may not be necessary to provide sound signals to transducers 12. Any conventional system (for example, an infrared system), could be used in place of wires 16.

Accordingly, the scope of the invention is to be construed in accordance with the substance defined by the following claims.

What is claimed is:

1. An acoustically active hot tub comprising:

a shell formed of an acrylic top sheet having fiberglass material applied to its underside; and a plurality of audio transducers affixed to the underside of said shell, said audio transducers able to accept signals from a sound source and to transform them into vibrations, wherein said audio transducers are affixed to blocks embedded into said fiberglass material applied to the underside of said shell.

2. The hot tub of claim 1 wherein said audio transducers are screwed into said blocks.

3. The hot tub of claim 2 wherein said blocks are made from marine grade plywood.

4. The hot tub of claim 1, further comprising:

a sound source integrated within said hot tub; and speaker wires connecting each of said audio transducers to said sound source.

5. The hot tub of claim 4 further comprising a cover enclosing each one of said audio transducers.

6. The hot tub of claim 5 wherein each one of said covers is stapled to one of said blocks.

7. The hot tub of claim 6 further comprising a remote control for operating said sound source.

8. The hot tub of claim 7 further comprising an infrared receiver and repeater for repeating an infrared signal received from said remote control to an infrared receiver associated with said sound system.

9. The hot tub of claim 8 wherein the infrared receiver and repeater is fixed into the wall of said hot tub.

10. The hot tub of claim 4 wherein said transducers are affixed to the top third of said shell.

11. The hot tub of claim 10 wherein said sound source is a sound source made for vehicles.

12. A method for making an acoustically active hot tub, the method comprising the steps of;

molding a sheet of acrylic into a predetermined form;

applying a fiberglass material to the underside of said sheet of acrylic, thereby forming a hot tub shell; and affixing a plurality of audio transducers to the underside of said shell, wherein the step of affixing said audio transducers to said shell further comprises the steps of:

embedding, for each transducer, a block of marine grade plywood into said fiberglass material before said material dries completely; and affixing each one of said transducers to one of said blocks.

13. The method of claim 12, wherein the step of affixing said transducers to said blocks comprises screwing the transducer into a hole pre-drilled into said block.

14. The method of claim 13, further comprising the step of providing a connection means between said audio transducers and a sound source.

* * * * *